United States Patent [19]

Weaver

[11] 4,325,502

[45] Apr. 20, 1982

[54] DISCHARGE CLOSURE FOR SILO UNLOADER

[76] Inventor: Richard L. Weaver, R.D. 4, Myerstown, Pa. 17067

[21] Appl. No.: 191,072

[22] Filed: Sep. 26, 1980

[51] Int. Cl.[3] ..... B67D 5/01

[52] U.S. Cl. ..... 222/504; 215/215; 215/252; 222/505; 222/549; 222/557

[58] Field of Search ..... 251/56, 58, 251, 252, 251/301, 215; 222/504, 505, 549, 557, 559, 512, 515, 547

[56] References Cited

U.S. PATENT DOCUMENTS

| | | | |
|---|---|---|---|
| 241,568 | 5/1881 | Spratt | 251/215 X |
| 1,231,400 | 6/1917 | Mackall | 222/557 X |
| 2,180,468 | 11/1939 | Hockstim | 222/549 X |
| 2,774,515 | 12/1956 | Johansson et al. | 222/556 X |
| 3,473,696 | 10/1969 | Morris | 222/556 X |

*Primary Examiner*—David A. Scherbel
*Attorney, Agent, or Firm*—Paul & Paul

[57] ABSTRACT

An openable discharge closure is provided, for silo bottom unloaders, in which the closure comprises a door-like member that is moved vertically downwardly and transversely away from the discharge opening. A sweeper or broom may be mounted for engagement by the upper surface of the closure as it moves laterally away from the opening. The motion of the closure is controlled by a single drive mechanism that provides both vertical and pivotal movement, with the vertical movement enabling the door to move upwardly or downwardly, and the pivotal movement enabling the door or closure to move transversely.

8 Claims, 6 Drawing Figures

DISCHARGE CLOSURE FOR SILO UNLOADER

BACKGROUND OF THE INVENTION

In the art of silo unloaders, particularly those of the bottom unloader type, a number of developments have enabled silage that is being conveyed to the generally central lower end of a silo, to be dispensed through an opening chute, to a location generally below the floor of a silo from which the silage may be lifted upwardly and outwardly by means of an exit conveyor. It has become commonplace to provide for a closure at the lower end of the silage discharge chute. Such closures are very desirable, in that they perform a number of functions, including the sealing off of silage located in the silo from outside air that may otherwise enter through the opening in the discharge chute. Other advantages of closures for discharge chutes in silos reside in preventing fall of silage through the chute, when silage is not desired, such as, during overnight conditions. Numerous other advantages are likewise attributed to closures for silage discharge chutes.

In the prior art relating to closures for silage discharge chutes, various mechanisms have been developed for facilitating the opening and closing of the discharge chutes. For example, in my prior U.S. Pat. No. 4,057,152, some such mechanisms are illustrated, that are very desirable. Also, in my U.S. Pat. No. 4,057,153, a hinged silo discharge chute closure is also disclosed, and which is one that is likewise highly desirable. In my U.S. Pat. No. 3,977,543, another type of hinged closure for a discharge chute is also disclosed, as there is likewise in my U.S. Pat. No. 3,874,524.

SUMMARY OF THE INVENTION

The present invention is directed toward an openable closure for a silage discharge chute that allows for vertical movement away from the chute opening, and transverse movement away from the area of silage discharge. A drive is provided that effects both movements of the closure. Additionally, an automatic sweeping function is provided for sweeping silage from the closure as it moves laterally away from the area of the chute opening, by moving the closure past a broom or like sweeping means.

Accordingly, it is a primary object of this invention to provide a novel openable closure for the bottom of a silage discharge chute.

It is a further object of this invention to accomplish the above object, using a single drive for effecting both the vertical and lateral or transverse motion of the closure away from the opening of the silage discharge chute.

It is another object of the present invention to accomplish the above objects, wherein an automatic sweeping function is provided, as the closure traverses a sweep means, during its movement away from the chute opening.

Other objects and advantages of the present invention will be readily apparent from a reading of the following brief descriptions of the drawing figures, detail description of the preferred embodiment, and the appended claims.

BRIEF DESCRIPTIONS OF THE DRAWING FIGURES

DETAILED DESCRIPTION OF THE PREFERRED EMBODIMENT

Figure 1:
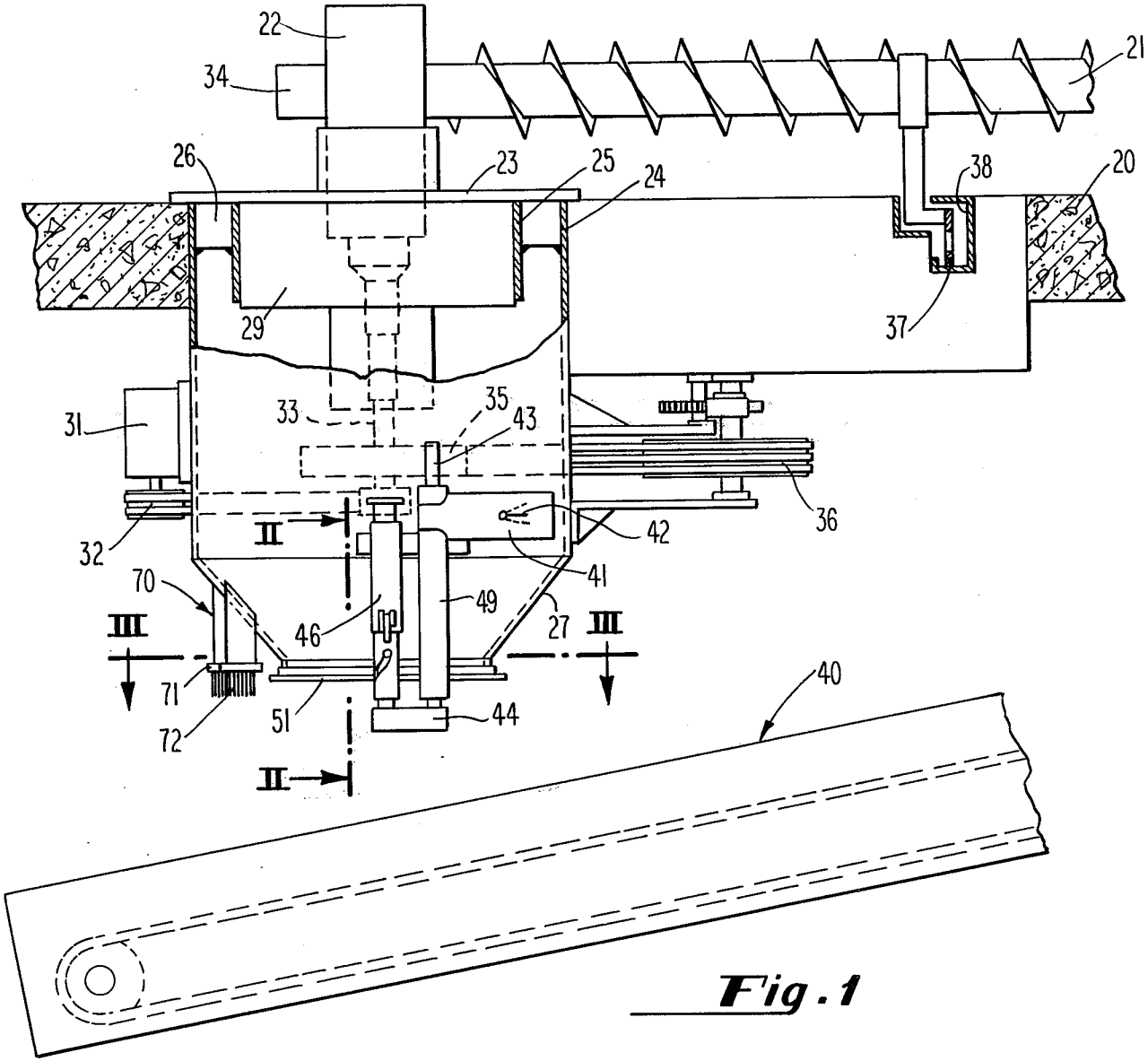
FIG. 1 is a fragmentary side elevational view, taken through the silo floor, illustrating in vertical elevation, a silo discharge auger, and the discharge chute, for discharging silage onto a discharge conveyor, through the discharge chute opening, and with the drive for effecting opening of the closure past a broom for sweeping the closure clean of silage, is likewise illustrated.
Figure 2:
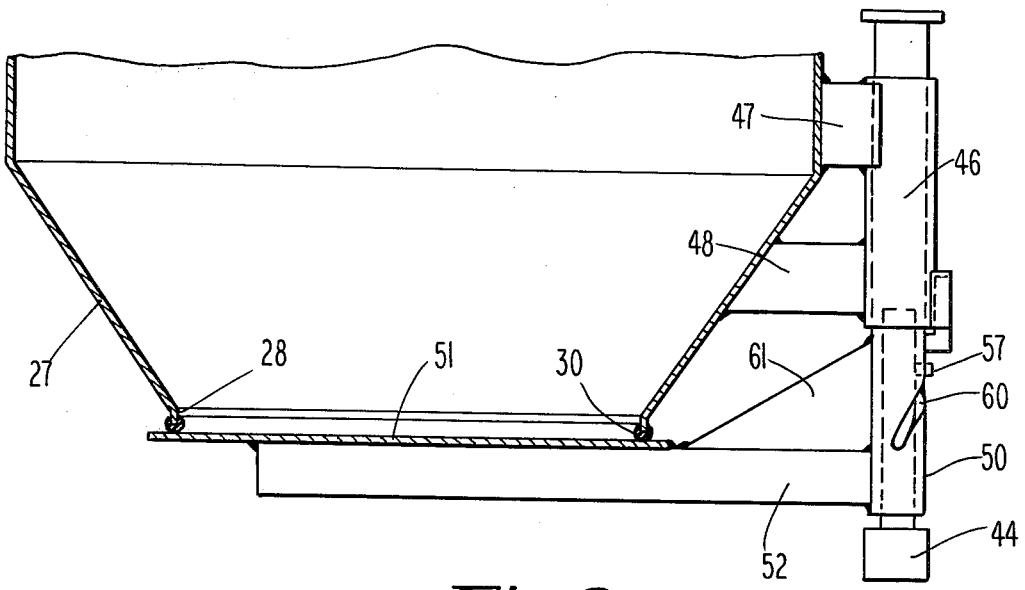
FIG. 2 is an enlarged fragmentary vertical sectional view, taken through the bottom end of the silage discharge chute, with the mechanism for controlling the movement of the closure being illustrated in elevation, and with the view being taken generally along the line II—II of FIG. 1.

Referring now to the drawings in detail, reference is first made to FIG. 1, wherein a silo unloader of the bottom unloader type is generally illustrated in the floor 20 of the silo.

The unloader includes an auger 21 adapted for rotation about its own axis, and for an advancing motion by arcuate movement of the auger 21 across the floor of a silo, by any suitable means, for example, by means disclosed in my above-identified patents. The auger 21 is mounted centrally at 22, in a transmission bearing or the like that is carried to allow auger movement as the auger 21 advances across the silo floor. The floor plate 23 and shaft support 29 extends diametrically across cylindrical chutes 24 and 25 that are fixedly carried in the floor 20, allowing silage flow through openings outside support 29, inside chute member 25. The cylindrical members 24 and 25 are connected by welded connection members 26. The bottom end of the discharge chute converges as at 27, to a smaller diameter opening 28 that, in turn, terminates in a closure seal 30, of rubber or the like.

A drive motor 31 is provided for driving, via a pulley belt arrangement 32, or the like, a shaft 33, that through an appropriate drive train, provides rotation about the auger's own axis, to the left-most end 34 of the auger 21, through transmission member 22, or in any other desired manner. If desired, the drive motor 31, can likewise, through a pulley belt arrangement 35, carried on shaft 34, also drive a pulley 36, that in turn may provide an advancing motion to a band 37 disposed in a track 38 in the floor of the silo. Alternatively, the band may be driven by any suitable means, such as that disclosed in my U.S. Pat. No. 4,057,151, but in any event will provide a sweeping traversal motion for the auger 21, across the floor of the silo, preferably in intermittent drive.

Beneath the opening 28 at the bottom of the silo, there is disposed, in an opening beneath the silo floor, a silage exit conveyor, generally designated by the numeral 40, which may be either of the auger or belt conveyor type, as desired, but which will be located to receive silage dispensed through the discharge chute opening 28.

At the lower end of the discharge chute 24, there is mounted a drive motor 41 that may be of any suitable type, electric, pneumatic, or the like, but which will preferably be electric, operable by means of a switch 42, shown in an off position, but which may be moved between phantom opening and closing positions as illustrated, to effect opening and closing of the closure. In any event, the motor 41 will be activated in some suitable manner, such that it will drive vertically moveable rod 43, through its guide member 44. The rod 43 may be driven in any suitable manner by the motor 41, but a suitable drive mechanism for accomplishing this may include a pinion gear (not shown) driven by the motor 41, that in turn drives a gear toothed rack that comprises a part of the rod 43 (likewise not shown) for driving the rod 43 upwardly or downwardly, as desired. The guide 44 is fixedly carried by the exterior of the chute 24, in any suitable manner.

Figure 4:
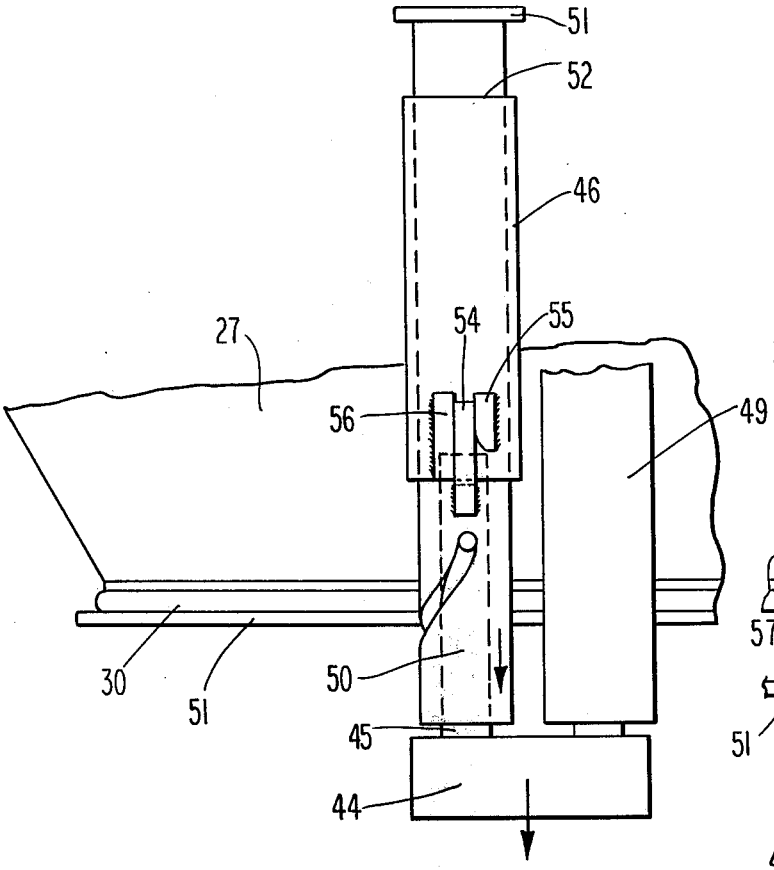
FIG. 4 is an enlarged fragmentary view of the drive mechanism at the bottom of the silo closure, as it commences its opening operation.
Figure 5:
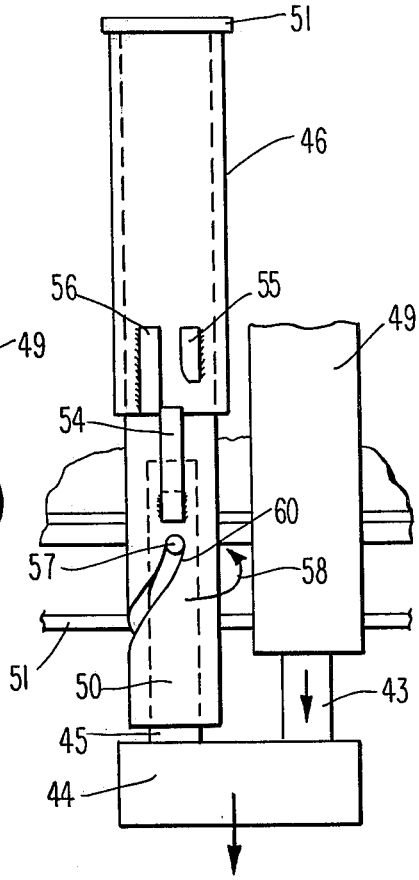
FIG. 5 is a view similar to that of FIG. 4, but in an advanced stage of closure opening, with the closure having been moved vertically downwardly away from the chute opening.
Figure 6:
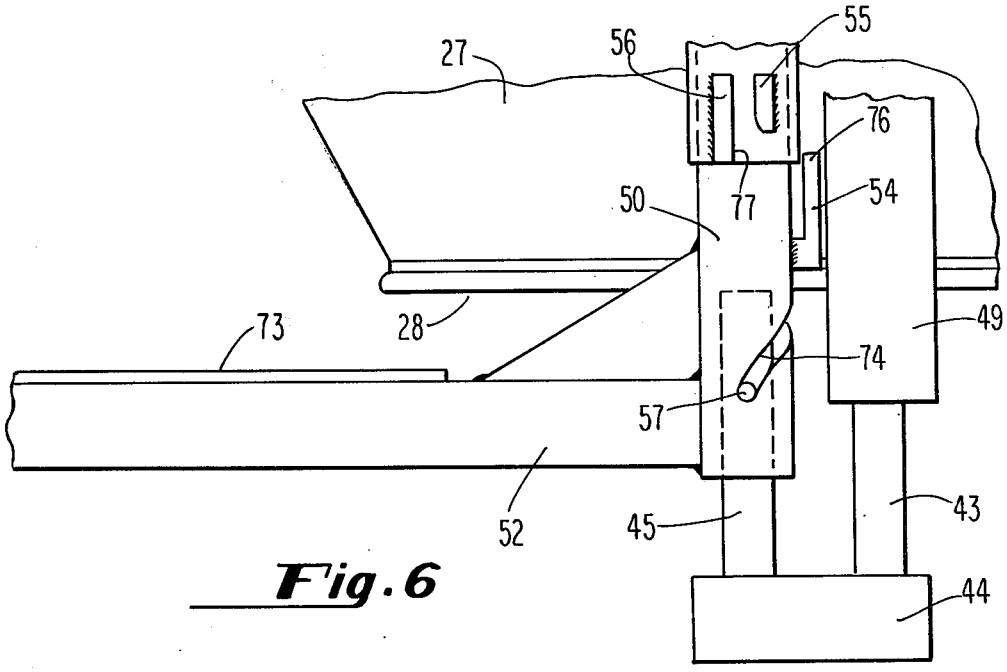
FIG. 6 is a view generally similar to that of FIGS. 4 and 5, but with the mechanism having now completed also the transverse movement of the closure away from the area at the bottom of the chute opening, by a pivotal motion as will be described more fully hereinafter.

Referring most particularly now to FIGS. 4 through 6, it is seen that the rod 43, is being moved vertically downwardly, and in turn moves an actuator base 44, likewise vertically downwardly, carrying an actuator rod 45 that is connected to the base 44, therewith, also in vertical downward movement.

A guide member 46 is fixedly carried by the exterior of the discharge chute by means of welded connections 47, 48 or the like, and forms a guideway for a vertically moveable slide member 50 disposed therein. As the motor 41 is thus actuated to drive the rod 43 downwardly, the weight of the slide member 50 and the closure 51 carried thereby through suitable support struts 52 or the like, will all facilitate the downward movement of the slide member 50 through the guideway 46, until the stop 51 at the upper end of the slide member 50 engages the upper end 52 of the slide member, thereby moving the closure from its position illustrated in FIG. 4 to the position illustrated in FIG. 5. During this downward movement of the slide member, its precise downward movement is facilitated by means of a guide plate 54 that is welded or otherwise suitably secured to the slide member 50, in sliding but guided engagement between guide plate 55 and 56 that are in turn welded or otherwise suitably fixedly secured to member 46.

As the closure moves from the position illustrated in FIG. 4 to that illustrated in FIG. 5, the guide 54 moves from its position between the guide plates 55 and 56, to the position illustrated in FIG. 5, in which the guide 54 is out of guided engagement relative to the plates 55 and 56.

At this point, with continued vertical downward movement of the post 43, the actuator post 45, by means of an actuator pin 57 fixedly carried thereby, causes the slide member 51 to be pivoted as indicated by the arrow 58 in FIG. 5. In doing so, the pin 57 engages the track or guideway 60 located in the slide member 50 and, as it moves downwardly, cams against the track 60, causing the slide member 50 to slidingly pivot about the post 45. As the slide member 50 pivots, it causes the closure 51 to likewise be carried in a traversing motion relative to the generally vertical path of silage flow through the opening 28, because the closure 51 is carried by supports 52 and 61 welded to the slide member 50, for movement therewith. As the slide member 50 thus pivots, the guide 54 is free to pivot from its position illustrated in FIG. 5 to its position illustrated in FIG. 6.

Figure 3:
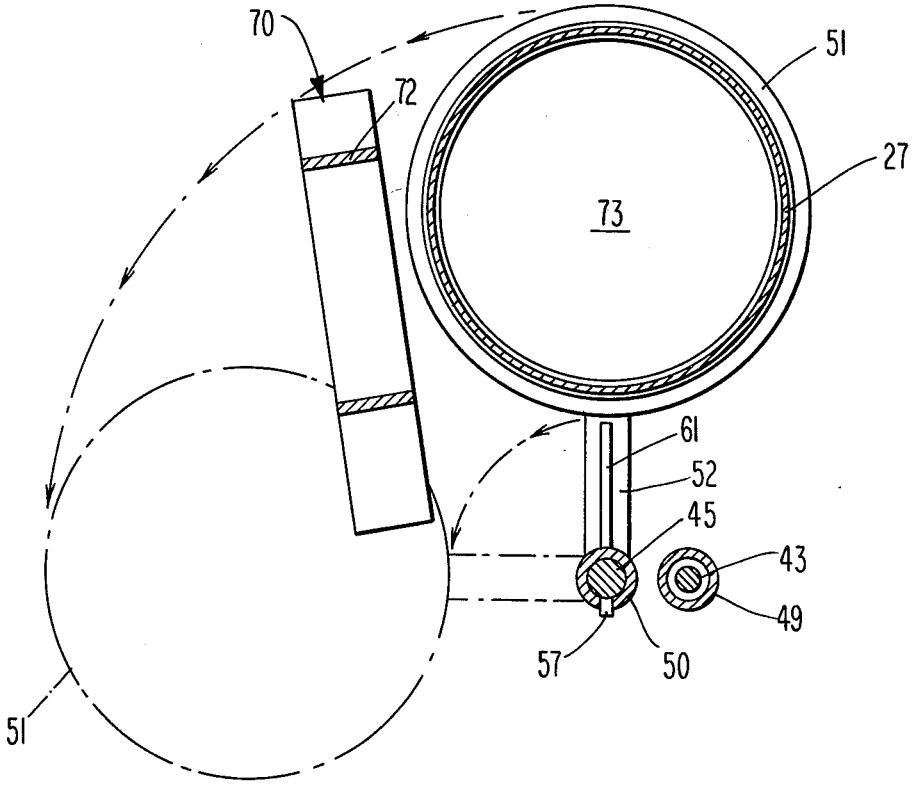
FIG. 3 is a top transverse sectional view, taken through the broom and lower end of the silo discharge chute, with the view being taken generally along the line III—III of FIG. 1, and with the closure being illustrated in its closed and opened positions, by means of the full line and phantom illustrations for the closure, respectively.

During the traversal motion of the closure member 51, in the path illustrated in phantom in FIG. 3, from its closed or full line position illustrated, to its phantom position illustrated, it will pass beneath a sweeping member generally designated by the numeral 70, disposed across the path. The sweeping member 70 comprises a brush or broom-like member 71 carried at the end of vertical supports 72 that are in turn carried by the discharge chute 24, fixedly therewith, with the broom portion 71 being so positioned and located such that its brushes 72 will sweep the upper surface 73 of the closure member 51 as the closure 51 moves therepast.

In effecting the closing of the closure 51, the switch 41 is actuated to a closing position, whereupon the rod 43 is drawn upwardly, in turn drawing upwardly the actuator, such that the actuator post 45 causes the pin 57 to engage against the upper surface 74 of the track 60, against the weight of the slide member 50, closure member 51, and other welded connections and the like, all of which weight will resist the upward motion of the slide member 50, until the pin 57 has overcome the frictional resistance of the track 60, and caused the closure member 51 to move from the position illustrated therefor in FIG. 6, back to its position illustrated in FIG. 5, disposed directly beneath the opening 28, at which point the pin 57 will be in engagement with the upper end of the track 60 as illustrated in FIG. 5, thereby operating in its continued upward movement, to lift the slide member 50 vertically upwardly, to its position illustrated in FIG. 4.

It will be noted that as the slide member 50 pivots from its position illustrated in FIG. 6 to that illustrated in FIG. 5, the guide plate 54 likewise moves from its position illustrated in FIG. 6 to that illustrated in FIG. 5, whereby an upper surface portion 76 thereof, butts against a lower surface portion 77 of the plate 56, creating a stop for the closing pivotal motion of the slide member 50, facilitating entry of the guide plate 54 between the guide plates 55 and 56, as the slide member moves from its position illustrated in FIG. 5 to that illustrated in FIG. 4. At this point, the closure member is fully closed.

It will be noted that, due to the inherent weight of the components that oppose the initial closing motion as rod 43 begins its upward movement, such will be in excess of the frictional forces that resist the turning motion of the slide member 50 relative to the actuator 45 and its pin 57, such that the slide member 50 will first pivot in the closing operation, and then be lifted upwardly.

From the foregoing, it will be apparent that the purposes of the present invention are accomplished, in providing a novel automatically operated closing or opening, from a single drive mechanism that effects both the transverse or pivoting motion, and the upward or downward, generally vertical motions of the components of the mechanism, and that during the traversing motion of the closure, a fixedly disposed broom or sweep member may clean the upper surface of the closure as the closure is moved therepast.

It will likewise be apparent from the foregoing that various modifications may be made in the details of construction and operation of the device of this invention, all within the spirit and scope of the invention, as defined in the appended claims.

I claim:

1. In a silo unloader of the bottom unloader type wherein silage is conveyed to a silage discharge chute generally centrally disposed at the lower end of the silo; said discharge chute having a discharge opening at the lower end thereof, and an openable single closure in closing relation to said discharge opening, the improvement comprising means for driving said closure in a single compound opening motion, both generally vertically downwardly and laterally transverse of the direction of silage flow through said opening, to open said opening, and in a single compound returning motion both laterally transverse and generally vertically upwardly, to close said opening, said means for driving said closure serving to maintain said closure in a substantially horizontal attitude throughout its motion.

2. The unloader of claim 1, wherein said drive means comprises a single drive mechanism for effecting the transverse and generally vertical motions.

3. In a silo unloader of the bottom unloader type wherein silage is conveyed to a silage discharge chute generally centrally disposed at the lower end of the silo; said discharge chute having a discharge opening at the lower end thereof, and an openable closure in closing relation to said discharge opening, the improvement comprising means for driving said closure in a compound opening motion, both generally vertically downwardly and transversely of the direction of silage flow through said opening, to open said opening, and in a compound returning motion both transversely and generally vertically upwardly, to close said opening, wherein said drive means comprises a single drive mechanism for effecting the transverse and generally vertical motions, wherein said closure is carried by a vertically disposed slide member; said slide member being mounted for generally vertical movement relative to a fixedly disposed generally vertical guideway member between upper and lower positions thereof; said slide member being mounted for pivotal movement relative to said guideway member in its lower position and including pivot guide means thereon; with pivot actuator means being mounted for generally vertical driving movement relative to said slide member and in cooperative engagement with said pivot guide means for controlling the pivotal movement of said slide member and consequently of said closure, in response to generally vertical movement of said pivot actuator means.

4. The unloader of claim 3, wherein said single drive means include a single vertical driver operatively connected to said actuator means for driving said slide member in both its pivotal and generally vertical movements through said actuator member.

5. The unloader of claim 4, wherein said single drive means is of the electrically driven rack and pinion type.

6. The unloader of claim 3, wherein said pivot guide means is of the helical cam type.

7. The unloader of claim 3, said guideway including vertical guide means carried thereby; said slide member having a vertical guide means carried thereby for movement therewith; said vertical guide means being cooperatively engaged during vertical movement of said slide member and being disengaged during pivotal movement of said slide member.

8. In a silo unloader of the bottom unloader type wherein silage is conveyed to a silage discharge chute generally centrally disposed at the lower end of the silo; said discharge chute having a discharge opening at the lower end thereof, and an openable closure in closing relation to said discharge opening, the improvement comprising means for driving said closure in a compound opening motion, both generally vertically downwardly and transversely of the direction of silage flow through said opening, to open said opening, and in a compound returning motion both transversely and generally vertically upwardly, to close said opening, wherein said drive means comprises a single drive mechanism for effecting the transverse and generally vertical motions, including sweeper means fixedly mounted relative to said closure along the path of transverse movement thereof, and comprising means for engaging the upper surface of said closure and sweeping silage therefrom, during the transverse movement thereof.

* * * * *